US006694863B1

(12) United States Patent
Kanai et al.

(10) Patent No.: US 6,694,863 B1
(45) Date of Patent: Feb. 24, 2004

(54) SWASH PLATE COMPRESSOR

(75) Inventors: Hiroshi Kanai, Saitama (JP); Shunichi Furuya, Saitama (JP)

(73) Assignee: Zexel Valeo Climate Control Corporation, Osato-gun (JP)

( * ) Notice: Subject to any disclaimer, the term of this patent is extended or adjusted under 35 U.S.C. 154(b) by 0 days.

(21) Appl. No.: 10/049,594

(22) PCT Filed: Sep. 8, 2000

(86) PCT No.: PCT/JP00/06142

§ 371 (c)(1),
(2), (4) Date: Feb. 13, 2002

(87) PCT Pub. No.: WO01/18392

PCT Pub. Date: Mar. 15, 2001

(30) Foreign Application Priority Data

Sep. 9, 1999 (JP) ..... 11-255500

(51) Int. Cl.[7] ..... F01B 3/00
(52) U.S. Cl. ..... 92/71; 92/169.1
(58) Field of Search ..... 92/71, 12.2, 169.1; 91/499; 417/269

(56) References Cited

U.S. PATENT DOCUMENTS 5,699,716 A * 12/1997 Ota et al. ..... 92/12.2
5,816,134 A * 10/1998 Takenaka et al. ..... 92/154
5,941,161 A * 8/1999 Kimura et al. ..... 92/71
6,209,444 B1 * 4/2001 Murakami et al. ..... 92/71
6,293,182 B1 * 9/2001 Yokomachi et al. ..... 92/71

OTHER PUBLICATIONS

Patent Abstracts of Japan, No. 11–241681 A (Toyota Automatic Loom Works, Ltd.) Sep. 7, 1999.
Patent Abstracts of Japan, No. 10–325389 A (Zexel Corporation), Dec. 8, 1998 & EP 881386, A.

* cited by examiner

*Primary Examiner*—Edward K. Look
*Assistant Examiner*—Igor Kershteyn
(74) *Attorney, Agent, or Firm*—Frishauf, Holtz, Goodman & Chick, P.C.

(57) ABSTRACT

A swash plate compressor includes a cylinder block, a shaft rotatably supported in a central portion of the cylinder block a swash plate which rotates along with rotation of the shaft a crankcase for retaining the swash plate, and pistons each connected to the swash plate and sliding in a corresponding one of the cylinder bores as the swash plate rotates. Each of the pistons includes a hollow cylindrical portion for sliding within the cylinder bore and a bridge for rollably supporting the pair of shoes. The bridge projects radially outward with respect to the hollow cylindrical portion. The cylinder block is formed with a projecting portion projecting from a central portion of a front end face thereof toward the crankcase, within a range limited such that the projecting portion does not interfere with the connecting portion.

12 Claims, 7 Drawing Sheets

SWASH PLATE COMPRESSOR

This application is a U.S. National Phase Application under 35 USC 371 of International Application PCT/JP00/06142 (not published in English) filed Sep. 8, 2000.

TECHNICAL FIELD

This invention relates to a swash plate compressor, and more particularly to a swash plate compressor suitable for use as a compressor for an automotive vehicle, which uses $CO_2$ (carbon dioxide) as a refrigerant.

BACKGROUND ART

FIG. 7 is a longitudinal cross-sectional view of a conventional swash plate compressor.

The swash plate compressor includes a cylinder block 101 having a plurality of cylinder bores 106 formed therein, a shaft 105 rotatably supported in a central portion of the cylinder block 101, a swash plate 110 which rotates along with rotation of the shaft 105, a crankcase 108 in which the swash plate 110 is received, and pistons 107 each of which is connected to the swash plate 108 via a pair of shoes 160, 161 and slides in a corresponding one of the cylinder bores 106 along with rotation of the swash plate 110.

The piston 107 is comprised of a hollow cylindrical portion 107*a* for sliding in the cylinder bore 106, and a bridge 107*b* rollably supporting the pair of shoes 160, 161.

The bridge 107*b* projects radially outward with respect to the hollow cylindrical portion 107*a* by a connecting portion 107*c* extending from a bottom portion 107*e* of the hollow cylindrical portion 107*a* in a radially outward direction of the cylinder block 101.

As the shaft 105 rotates, the swash plate 110 rotates along with rotation of the shaft 105. The rotation of the swash plate 110 causes relative rotation of the shoes 160, 161 on sliding surfaces 110*a*, 110*b* of the swash plate 110, which converts rotation of the swash plate 110 into reciprocating motion of each piston 7.

As a result, the volume of a compression chamber 122 within the cylinder bore 106 changes, which causes suction, compression and delivery of refrigerant gas to be sequentially carried out, whereby refrigerant gas is delivered from the compression chamber 122 in an amount corresponding to the angle of inclination of the swash plate 110.

During this operation, the compression reaction force from refrigerant gas compressed by the reciprocating motion of the piston 107 is received by the inclined swash plate 110, so that tilting loads R1, R2 are applied on the piston 107 as shown in the figure.

The tilting loads R1, R2 are dependent on dimensions L1, L2 shown in the figure, such that the loads R1, R2 become smaller as the length L1 is longer (i.e. the length L2 is shorter). Here, L1 represents the distance between the point of application of the tilting load R1 on a top side of the piston 107 and the point of application of the tilting load R2 on a bottom side of the same, while L2 represents the distance between the point of application of the tilting load R2 and the point of application of the compression reaction force from the swash plate 110.

It should be noted that in a compressor using $CO_2$ as a refrigerant, the difference between high pressure and low pressure is so large (approximately 15 MPa at the maximum) that the compression reaction force generated during a compression stroke of a piston is larger than in a conventional compressor using chlorofluorocarbon as a refrigerant.

Further, the delivery quantity of the compressor using $CO_2$ is ⅙ to 1/10 of that of the conventional compressor using chlorofluorocarbon, and the diameter of each cylinder bore 106 of the former is as small as ⅓ to ½ of that of the latter, so that surface pressure becomes much higher.

Moreover, the pistons 107 and the cylinder bores 106 are abraded due to sliding frictions between the pistons 107 and the respective cylinder bores 106, which are caused by the tilting loads R1, R2.

Furthermore, the edge (peripheral edge of the top surface) of each piston 7 removes lubricating oil attached to the corresponding cylinder bore 106, so that the breaking of oil film can cause seizure of the piston 107.

It is an object of the invention to reduce tilting load acting on each piston to thereby provide a highly durable and reliable swash plate compressor.

DISCLOSURE OF INVENTION

To achieve the above object, the present invention provides a swash plate compressor including a cylinder block having a plurality of cylinder bores formed therein, a rotational shaft rotatably supported in a central portion of the cylinder block, a swash plate which rotates along with rotation of the rotational shaft, a crankcase in which the swash plate is received, and pistons each connected to the swash plate via a pair of shoes and sliding in a corresponding one of the cylinder bores along with rotation of the swash plate, and wherein each of the pistons comprises a hollow cylindrical portion for sliding in the cylinder bore, and a bridge for rollably supporting the pair of shoes, the bridge projecting radially outward with respect to the hollow cylindrical portion by a connecting portion extending from a bottom portion of the cylindrical portion in a radially outward direction of the cylinder block, characterized in that the cylinder block is formed with a projecting portion projecting from a central portion of a front end face thereof toward the crankcase, within a range limited such that the projecting portion does not interfere with the connecting portion.

Since the cylinder block is formed with the projecting portion projecting from the central portion of the front end face thereof toward the crankcase, within the range limited such that the projecting portion does not interfere with the connecting portion, a point of application of a tilting load on the bottom side of the piston for tilting the piston is shifted toward the front head side of the same, whereby the distance between the point of application of the tilting load on the top side of the piston and the point of application of the tilting load on the bottom side of the same is increased. Consequently, the tilting load is reduced, whereby abrasion between the piston and the cylinder block is decreased, which enhances durability. Further, friction loss is reduced, and slidability of each piston is improved, which makes it possible to reduce the driving force of the compressor, thereby enhancing performance and reliability of the same.

Preferably, the projecting portion has a generally hollow cylindrical shape in side view.

Since the projecting portion is has a generally hollow cylindrical shape in side view, it is easy to machine the same.

Preferably, the projecting portion has a generally hollow truncated cone shape in side view.

Since the projecting portion is generally conical in shape in side view, it is easy to remove burrs produced when the projecting portion is machined, which improves machining efficiency.

Preferably, the hollow cylindrical portion has a portion of a bottom-side end thereof extended to a location radially opposed to the connecting portion.

Since the portion of the bottom-side end of the cylindrical portion is extended to the location radially opposed to the connecting portion, the bottom-side end portion of the piston is not completely received in the cylinder bore even when the piston is close to its top dead center position. Therefore, the tilting load is progressively reduced as the piston becomes close to its top dead center position.

Preferably, the projecting portion has a generally hollow cylindrical shape in side view, and the hollow cylindrical portion has a portion of a bottom-side end thereof extended to a location radially opposed to the connecting portion.

Preferably, the projecting portion has a generally truncated cone shape in side view, and the hollow cylindrical portion has a portion of a bottom-side end thereof extended to a location radially opposed to the connecting portion.

Preferably, the cylindrical portion of the piston is formed with an annular groove always radially opposed to an inner peripheral surface of the cylinder bore.

Since the cylindrical portion of the piston is formed with the annular groove always radially opposed to the inner peripheral surface of the cylinder bore, it is possible to hold lubricating oil in the annular groove. Consequently, it is possible to prevent breaking of oil film on the piston, and seizure of the same resulting therefrom.

Preferably, the projecting portion has a generally hollow cylindrical shape in side view, and the hollow cylindrical portion of the piston is formed with an annular groove always radially opposed to an inner peripheral surface of the cylinder bore.

Preferably, the projecting portion has a generally truncated cone shape in side view, and the hollow cylindrical portion of the piston is formed with an annular groove always radially opposed to an inner peripheral surface of the cylinder bore.

Preferably, the hollow cylindrical portion has a portion of a bottom-side end thereof extended to a location radially opposed to the connecting portion, and the hollow cylindrical portion of the piston is formed with an annular groove always radially opposed to an inner peripheral surface of the cylinder bore.

Preferably, the projecting portion has a generally hollow cylindrical shape in side view, and the hollow cylindrical portion has a portion of a bottom-side end thereof extended to a location radially opposed to the connecting portion, the hollow cylindrical portion being formed with an annular groove always radially opposed to an inner peripheral surface of the cylinder bore.

Preferably, the projecting portion has a generally truncated cone shape in side view, and the hollow cylindrical portion has a portion of a bottom-side end thereof extended to a location radially opposed to the connecting portion, the hollow cylindrical portion being formed with an annular groove always radially opposed to an inner peripheral surface of the cylinder bore.

BEST MODE OF CARRYING OUT THE INVENTION

Hereafter, an embodiment of the invention will be described with reference to drawings.

Figure 1:
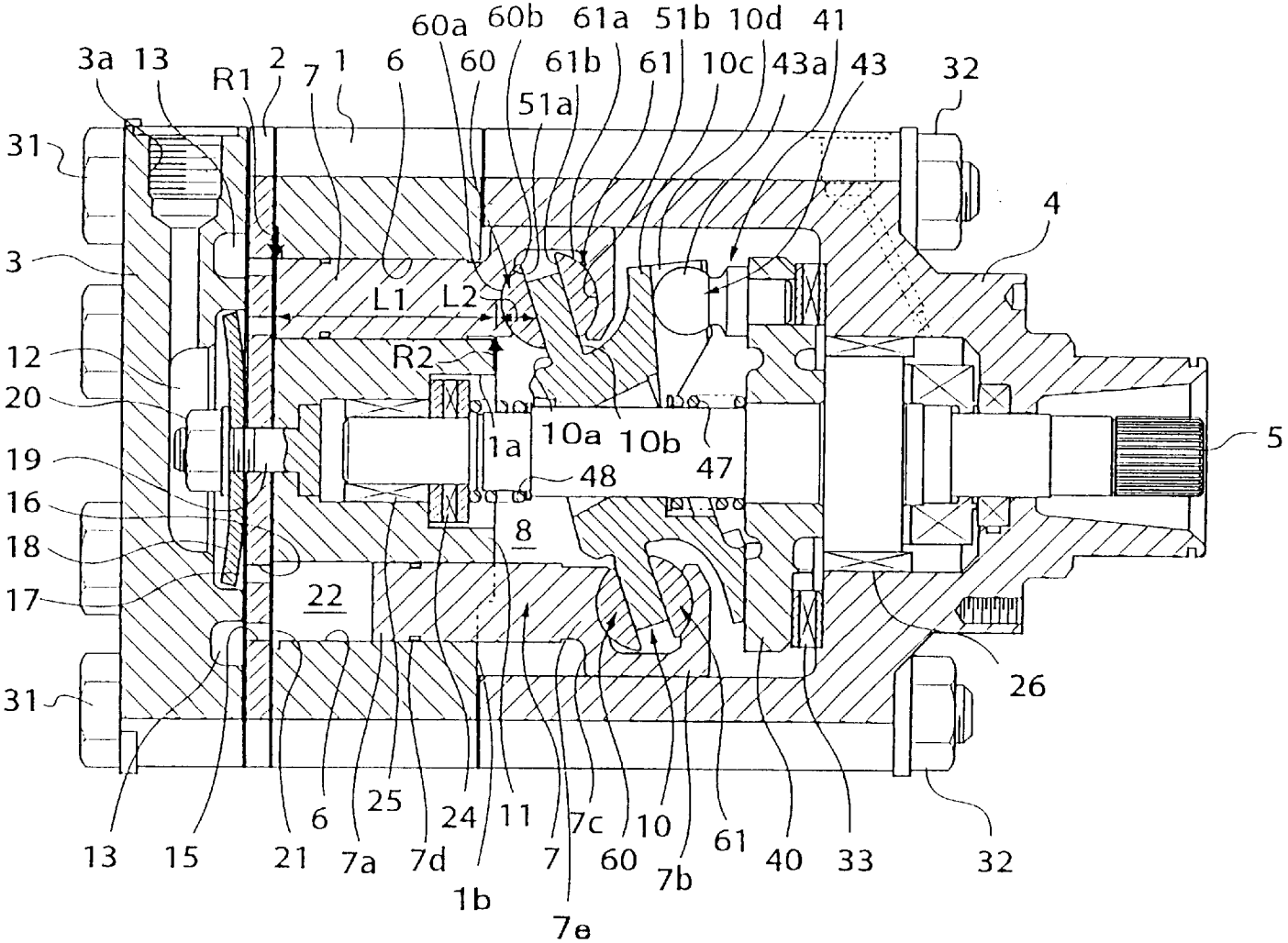
FIG. 1 is a longitudinal cross-sectional view showing a swash plate compressor according to an embodiment of the invention.

FIG. 1 is a longitudinal cross-sectional view of a swash plate compressor according to an embodiment of the invention.

The swash plate compressor is used as a component of a refrigerator using $CO_2$ (carbon dioxide) as a refrigerant. The swash plate compressor has a cylinder block 1 having one end thereof secured to a rear head 3 via a valve plate 2 and the other end thereof secured to a front head 4. The front head 4, the cylinder block 1, the valve plate 2 and a rear head 3 are connected in an axial direction by through bolts 31 and nuts 32 to form a one-piece assembly.

The cylinder block 1 is formed with cylinder bores 6 in each of which a piston 7 is slidably inserted.

Within the front head 4, there is formed a crankcase 8 in which a swash plate 10 and a thrust flange 40, referred to hereinafter, are received. Further, within the rear head 3, there are formed a suction chamber 13 and a discharge chamber 12 in a manner such that the suction chamber 13 surrounds the discharge chamber 12. The suction chamber 13 receives a low-pressure refrigerant gas to be supplied to each compression chamber 22, while the discharge chamber 12 receives a high-pressure refrigerant gas delivered from each compression, chamber 22.

The shaft (rotational shaft) 5 has one end thereof rotatably supported via a radial bearing 26 by the front head 4 and the other end thereof rotatably supported via a thrust bearing 24 and a radial bearing 25 by the cylinder block 1.

The thrust flange 40 is fixedly fitted on the shaft 5, for rotation in unison with the same. The swash plate 10 is tiltably and slidably mounted on the shaft 5. Further, the swash plate 10 is connected to the thrust flange 40 via a linkage 41, for rotation in unison with the same.

A peripheral portion of the swash plate 10 and one end of each piston 7 are connected to each other via a pair of shoes 60, 61 each of which has a convex (spherical) surface 60*a* (61*a*) and a flat surface 60*b* (61*b*).

The pair of shoes 60, 61 are arranged on the swash plate 10 in a manner sandwiching the same. The shoes 60, 61 perform relative rotation on respective sliding surfaces 10*a*, 10*b* of the swash plate 10 as the shaft 5 rotates. The piston 7 reciprocates in the cylinder bore 6 along with rotation of the swash plate 10.

The valve plate 2 is formed with refrigerant outlet ports 16 each for communicating between a compression chamber 22 and the discharge chamber 12, and refrigerant inlet ports 15 each for communicating between a compression chamber 22 and the suction chamber 13. The refrigerant outlet ports 16 and the refrigerant inlet ports 15 are arranged at predetermined circumferential intervals. The refrigerant outlet ports 16 are opened and closed by respective discharge valves 17. The discharge valves 17 are fixed to a rear head-side end face of the valve plate 2 by a bolt 19 and a nut 20 together with a valve stopper 18. Also, the refrigerant inlet ports 15 are opened and closed by respective suction valves 21 arranged on a front end face of the valve plate 2.

The thrust flange 40 rigidly fitted on a front-side end of the shaft 5 is rotatably supported on an inner wall of the front head 4 via a thrust bearing 33. The thrust flange 40 and the swash plate 10 are connected with each other via a linkage 41, as described above, and the swash plate 10 can tilt with respect to a plane perpendicular to the shaft 5. The linkage 41 is comprised of a bracket 10*c* formed on the sliding surface 10*a* of the swash plate 10, a linear guide groove 10*d* formed in the bracket 10*c*, and a rod 43 press-fitted into the thrust flange 40. The longitudinal axis of the guide groove 10*d* is inclined at a predetermined angle with respect to the sliding surface 10*b* of the swash plate 10. The rod 43 has one spherical end 43*a* thereof relatively slidably fitted in the guide groove 10*d*.

A coil spring 47 is fitted on the shaft 5 between the thrust flange 40 and the swash plate 10 to urge the swash plate 10 rearward, while a coil spring 48 is fitted on the shaft 5 between the thrust bearing 24 and, the swash plate 10 to urge the swash plate 10 frontward.

Figure 2:
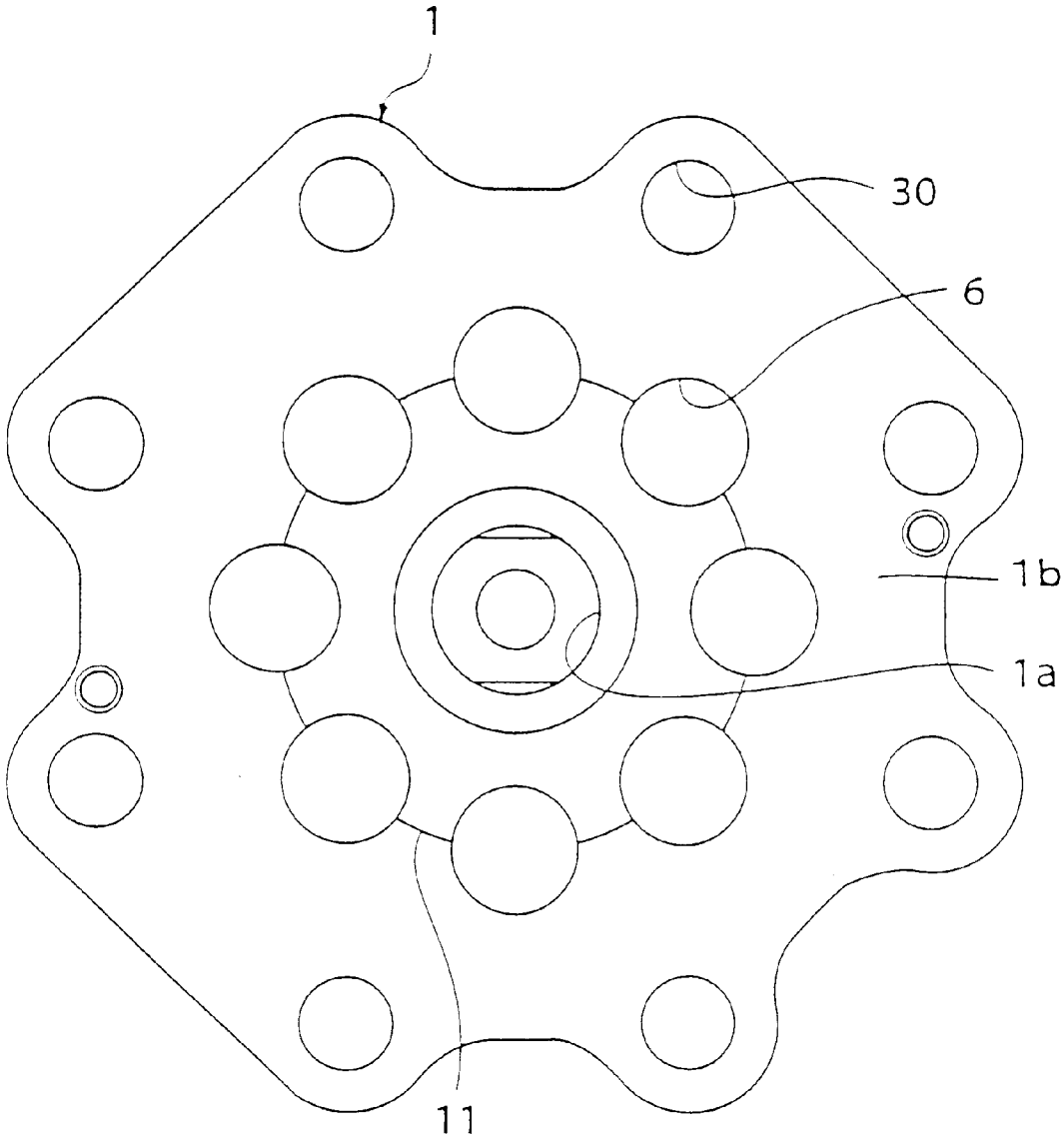
FIG. 2 is a front-side end view of a cylinder block.
Figure 3:
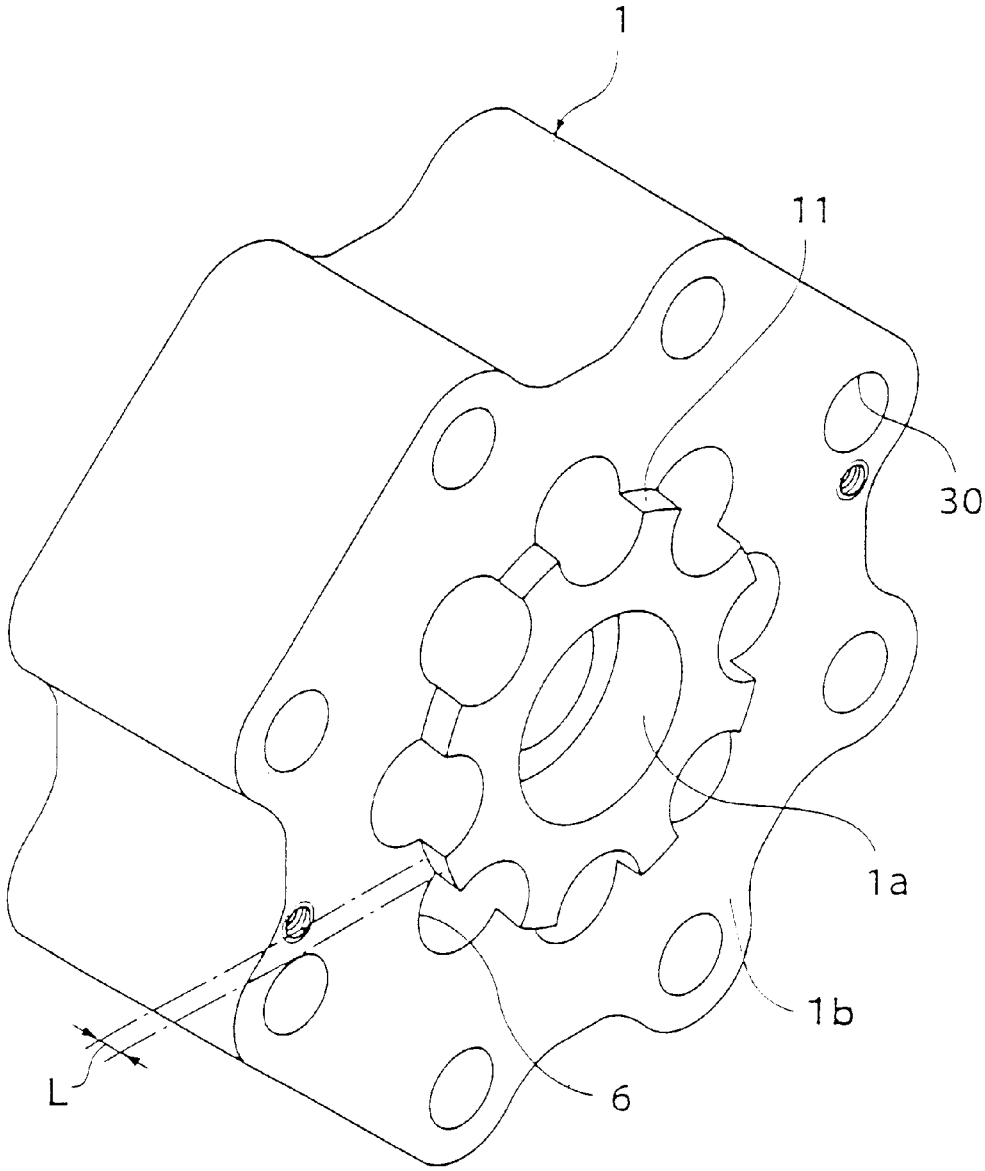
FIG. 3 is a perspective view of the cylinder block.

FIG. 2 is a front end view of the cylinder block, and FIG. 3 is a perspective view of the same.

The cylinder block 1 has eight cylinder bores 6 axially extending there through at predetermined circumferential intervals about a hole la through which the shaft 5 extends. Radially outward of the cylinder bores 6, there are formed eight through holes 30 through which the bolts extend.

Further, on a central portion of a front end surface 1*b* of the cylinder block 1, there is formed a protecting portion 11 having a generally hollow cylindrical shape in side view. The protecting portion 11 projects toward the crankcase 8 by a dimension L limited such that the projecting portion 11 does not interfere with connecting portions 7*c*, referred to hereinafter, of the respective pistons 7. The outer periphery of the protecting portion 11 is on an circumference connecting the centers of the respective cylinder bores 6.

Figure 4:
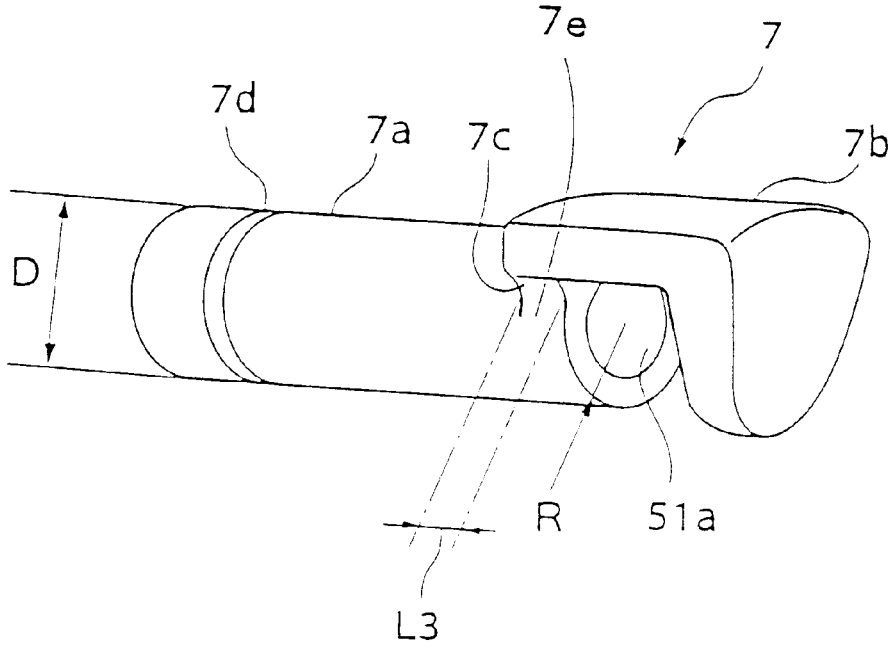
FIG. 4 is a perspective view of a piston.

FIG. 4 is a perspective view of the piston.

The piston 7 is comprised of a hollow cylindrical portion 7*a*, a bridge 7*b* and the connecting portion 7*c*.

The hollow cylindrical portion 7*a* is slidably inserted in the cylinder bore 6. The hollow cylindrical portion 7*a* has a top-side portion thereof formed with an annular groove 7*d*. The annular groove 7*d* is always radially opposed to the inner peripheral surface of the cylinder bore 6.

At a bottom-side end of the hollow cylindrical portion 7*a*, there are formed shoe pockets 51*a*, 51*b* (see FIG. 1) for rollably supporting the pair of shoes 60, 61, respectively.

Further, a portion of the bottom-side end of the hollow cylindrical portion 7*a* is extended to a location radially opposed to the connecting portion 7*c*. The extended portion is arcuate in cross section, and assuming that the radius of the extended portion is R, and the diameter of the hollow cylindrical portion 7*a* is D, the relationship between the radius R of the extended portion and the diameter D of the hollow cylindrical portion 7*a* is represented as R=D/2.

The bridge 7*b* projects from the hollow cylindrical portion 7*a* in a radially outward direction of the cylinder block 1 by the connecting portion 7*c* extending radially outward from a bottom portion 7*e* of the cylindrical portion 107*a*. Assuming that the thickness of the connecting portion 7*c* is L3, the relationship between the thickness L3 of the connecting portion 7*c* and the dimension L of the projecting portion 11 is represented as L3>L.

Next, the operation of the variable capacity swash plate compressor constructed as above will be described.

Torque of an engine, not shown, installed on an automotive vehicle, not shown, is transmitted to the shaft 5 to rotate the same. The torque of the shaft 5 is transmitted to the swash plate 10 via the thrust flange 40 and the linkage 41 to cause rotation of the swash plate 10.

When the swash plate 10 is rotated, the shoes 60, 61 perform relative rotation on the respective sliding surfaces 10*a*, 10*b* of the swash plate 10, whereby the rotation of the swash plate 10 is converted into the reciprocating motion of each piston 7.

As the piston 7 reciprocates in the cylinder bore 6 associated therewith, the volume of a compression chamber 22 within the cylinder bore 6 changes, which causes, suction, compression and delivery of refrigerant gas to be sequentially carried out, whereby high-pressure refrigerant gas is delivered from the compression chamber 22 in an amount corresponding to the angle of inclination of the swash plate 10.

During the suction stroke of the piston 7, the corresponding suction valve 21 opens to draw low-pressure refrigerant gas from the suction chamber 13 into the compression chamber 22 within the cylinder bore 6. During the discharge stroke of the piston 7, the corresponding discharge valve 17 opens to deliver high-pressure refrigerant gas from the compression chamber 22 to the discharge chamber 12. The high-pressure refrigerant gas within the discharge chamber 12 is discharged from a discharge port 3*a* to a condenser, not shown.

During each compression stroke, a compression reaction force of the piston 7 acts on the swash plate 10. The compressor is of a type using $CO_2$ as a refrigerant, and hence the compression reaction force from the piston 7 is larger than when the compressor is of a type using chlorofluorocarbon as a refrigerant, as described herein before.

Figure 5:
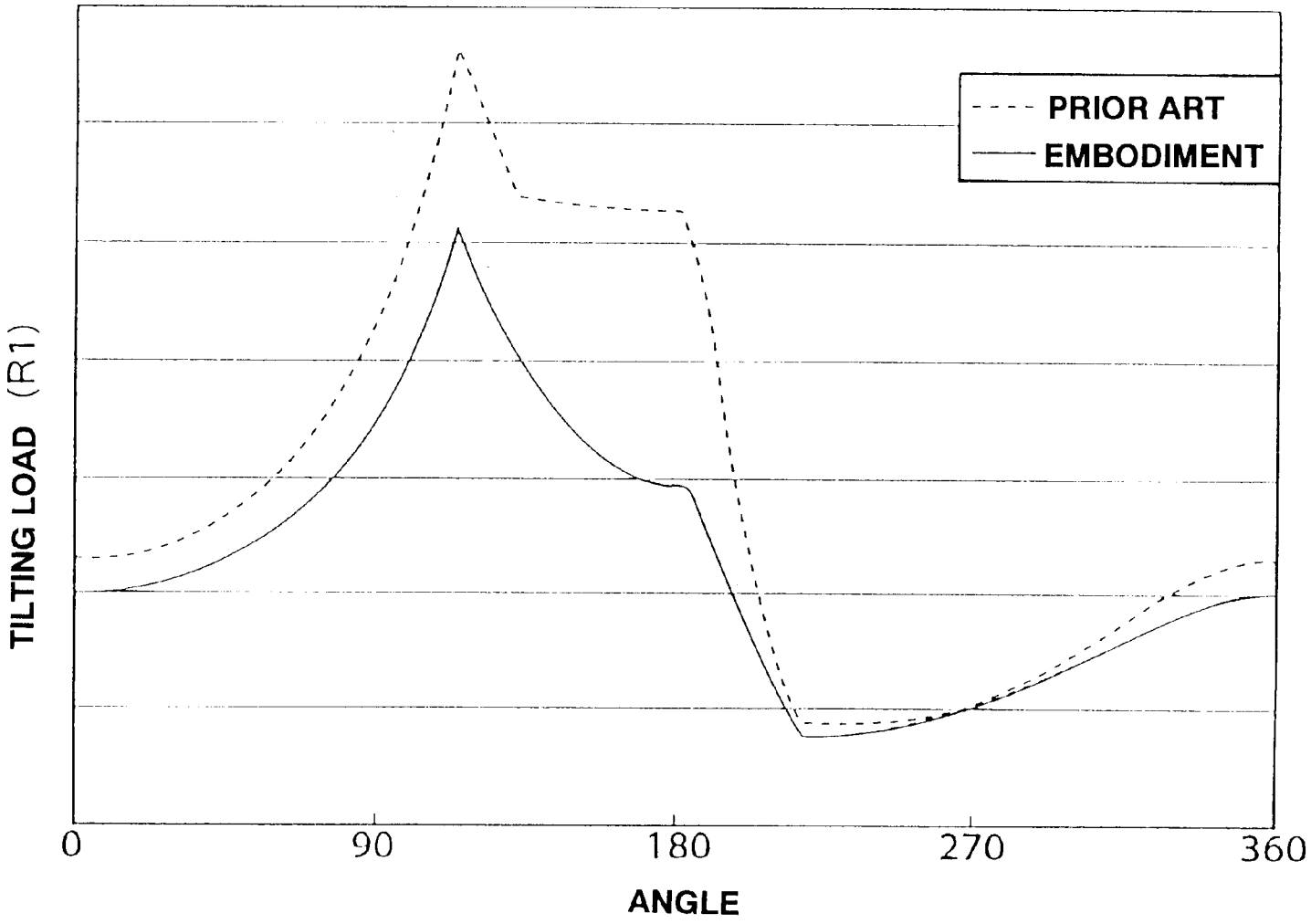
FIG. 5 is a graph showing the relationship between a rotational angle of a rotational shaft and a tilting load on a top side of the piston.
Figure 6:
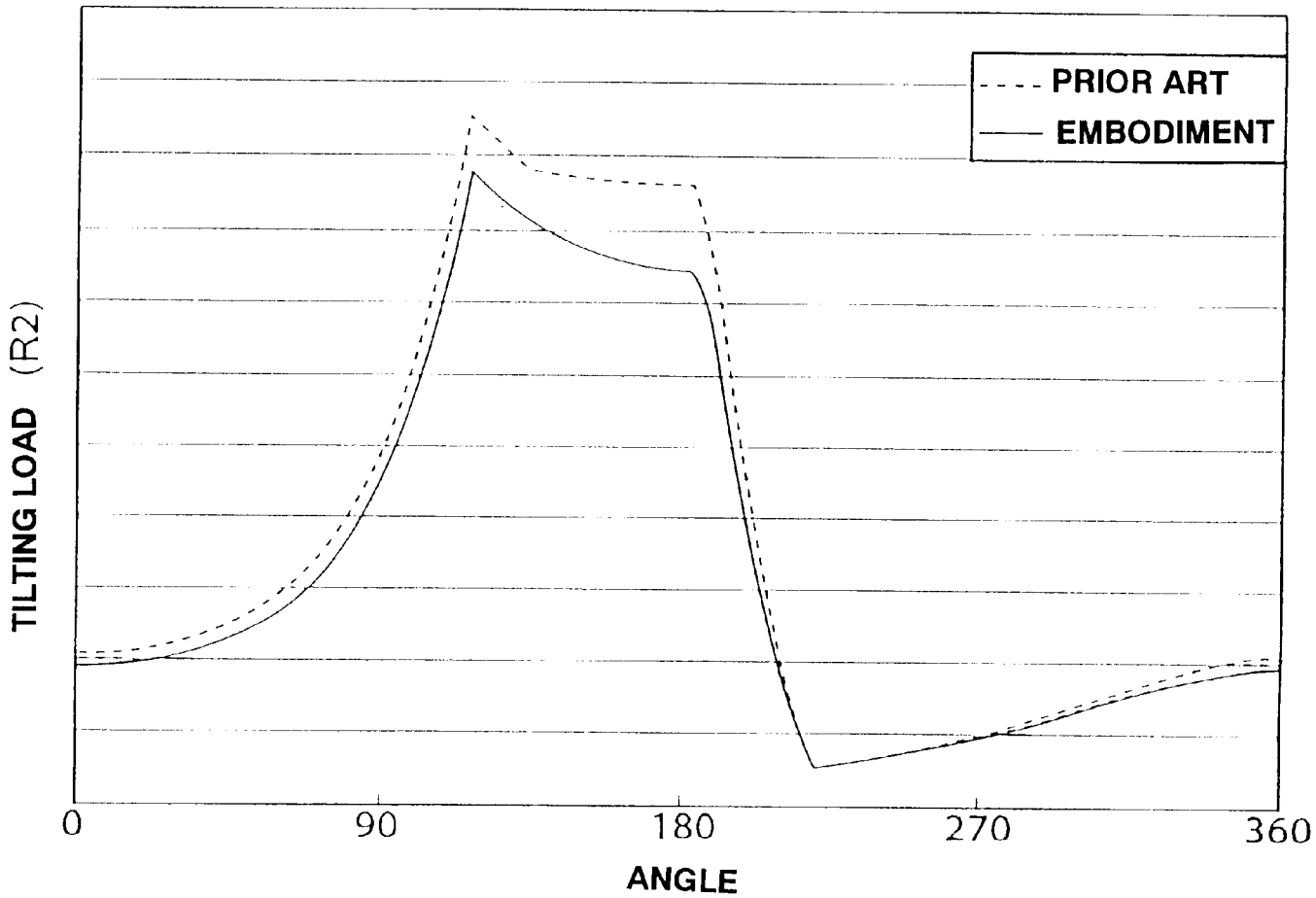
FIG. 6 is a graph showing the relationship between the rotational angle of the rotational shaft and a tilting load on a bottom side of the piston.
Figure 7:
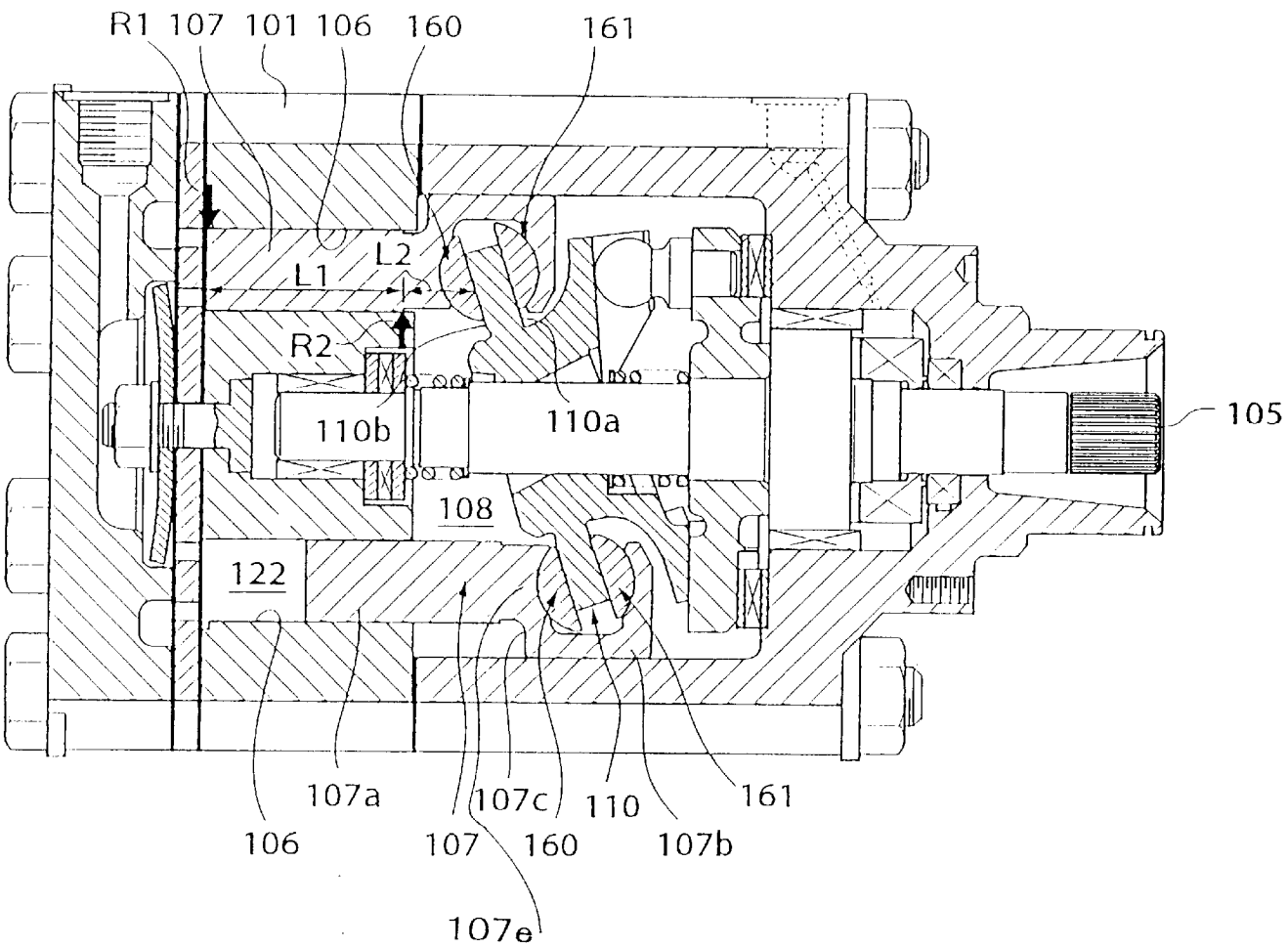
FIG. 7 PRIOR ART
FIG. 7 is a longitudinal cross-sectional view showing a conventional swash plate compressor.

However, in the present embodiment, since the dimension L1 is longer, and the dimension L2 is shorter than in the prior art, tilting loads R1, R2 are reduced as shown in FIGS. 5 and 6.

FIG. 5 is a graph showing the relationship between the rotational angle of the rotational shaft and the tilting load on the top side of the piston, while FIG. 6 is a graph showing the relationship between the rotational angle of the rotational shaft and the tilting load on the bottom side of the piston. In each of the figures, a solid line indicates the case of the present embodiment, and a dotted line indicates the case of the prior art.

On the top side of the piston 7, the maximum value of the tilting load R1 in the present embodiment is reduced from that in the prior art by approximately 25 %. Further, in the present embodiment, as the piston 7 moves closer to its top dead center position (180 degrees), the tilting load R1 is smoothly reduced and becomes by far smaller than in the prior art.

Further, on the bottom side of the piston 7 as well, the maximum value of the tilting load R2 in the present embodiment is reduced from that in the prior art by approximately 8%, and the tilting load R2 applied on the piston 7 at its top dead center position (180 degrees) is also smaller than that in the prior art.

When thermal load on the compressor decreases to increase pressure within the crankcase 8, the angle of inclination of the swash plate 10 decreases, and hence the length of stroke of the piston 7 is decreased to reduce the delivery quantity or capacity of the compressor. On the other hand, when the thermal load on the compressor increases, the pressure within the crankcase 8 is lowered to increase the angle of inclination of the swash plate 10, whereby the length of stroke of the piston 7 is increased to increase the delivery quantity or capacity of the compressor.

According to the present embodiment, as compared with the prior art, L1 is longer, and L2 is shorter, so that the tilting loads R1, R2 are reduced, and particularly, the tilting load R1 on the top side of the piston 7 becomes largely reduced, which reduces abrasion of the cylinder bore 6 and the piston 7 due to sliding frictions between these, thereby enhancing durability thereof.

Further, since friction loss is reduced, and the sliding characteristic is improved, it is possible to reduce driving force of the compressor, thereby enhancing performance and reliability of the same.

Moreover, since the bottom-side end of the piston 7 is not completely received in the cylinder bore 6 even when the piston 7 is close to its top dead center position, the tilting loads R1, R2 are progressively reduced as the piston 7 moves toward its top dead center position.

Furthermore, since lubricating oil-holding capability is improved by the annular groove 7*d*, it is possible to prevent breaking of oil film on the piston 7, and seizure of the piston 7 resulting therefrom.

Although in the above embodiment, the projecting portion 11 has a hollow cylindrical shape in side view, this is not limitative, but it may have a truncated cone shape in side view, for example. This shape facilitates deburring in machining.

Further, the periphery of the projecting portion 11 is not absolutely required to be on the imaginary circumference connecting the centers of the respective cylinder bores 6, but it may be located radially outward of the imaginary circumference.

Still further, the position of the annular groove 7*d* is not limited to the top side of the piston 7, but the annular groove 7*d* may be formed at any location on the piston 7 which can be always radially opposed to the inner peripheral surface of the cylinder bore 6.

Moreover, the number of the annular groove 7*d* on the piston 7 is not limited to one as in the above embodiment, but a plurality of annular grooves may be formed. In this case, it is possible to further enhance the lubricating oil-holding capability of the piston 7.

Although in the above embodiment, description is made of a case in which the invention is applied to a variable capacity swash plate compressor, this is not limitative, but the invention may be applied to a fixed capacity swash plate compressor.

INDUSTRY APPLICABILITY

As described above, the swash plate compressor according to the invention is useful as a refrigerant compressor for use in an air conditioning system installed on an automotive vehicle. According to this swash plate compressor, tilting load is decreased, whereby abrasion of the pistons and the cylinder block is reduced to enhance durability of the compressor. Further, friction loss is reduced, and slidability is improved, so that it is possible to reduce driving force of the compressor, thereby enhancing performance and reliability of the same.

What is claimed is:

1. A swash plate compressor comprising:

a cylinder block having a plurality of cylinder bores formed therein;

a rotational shaft rotatably supported in a central portion of said cylinder block;

a swash plate which moves pistons along with rotation of said rotational shaft;

a crankcase in which said swash plate is received;

said pistons each connected to said swash plate via a pair of shoes and sliding in a corresponding one of said cylinder bores, each of said pistons having a cylindrical portion for sliding in said cylinder bore, and a bridge for rollably supporting said pair of shoes, said bridge projecting radially outward with respect to said cylindrical portion by a connecting portion extending from a bottom portion of said cylindrical portion in a radially outward direction of said cylinder block; and a projecting portion formed on a central portion of a front end face of said cylinder block, said projecting portion projecting toward said crankcase, within a range limited such that said projecting portion does not interfere with said connecting portion, the inside of the cylinder bore on which said cylindrical portion slides being extended by the projecting portion on a center portion of the cylinder block.

2. A swash plate compressor according to claim 1, wherein said protecting portion has a generally hollow cylindrical shape in side view.

3. A swash plate compressor according to claim 1, wherein said protecting portion has a generally hollow truncated cone shape in side view.

4. A swash plate compressor according to claim 1, wherein said cylindrical portion of said piston has a portion of a bottom-side end thereof which extends to a location radially opposed to said connecting portion.

5. A swash plate compressor according to claim 1, wherein said projecting portion has a generally hollow cylindrical shape in side view, and wherein said cylindrical portion of said piston has a portion of a bottom-side end thereof which to a location radially opposed to said connecting portion.

6. A swash plate compressor according to claim 1, wherein said projecting portion has a generally truncated cone shape in side view, and wherein said cylindrical portion of said piston has a portion of a bottom-side end thereof which extends extended to a location radially opposed to said connecting portion.

7. A swash plate compressor according to claim 1, wherein said cylindrical portion of said piston is formed with an annular groove which is radially opposed to an inner peripheral surface of said cylinder bore.

8. A swash plate compressor according to claim 1, wherein said projecting portion has a generally hollow cylindrical shape in side view, and wherein said cylindrical portion of said piston is formed with an annular groove which is radially opposed to an inner peripheral surface of said cylinder bore.

9. A swash plate compressor according to claim 1, wherein said protecting portion has a generally truncated cone shape in side view, and wherein said cylindrical portion of said piston is formed with an annular groove which is radially opposed to an inner peripheral surface of said cylinder bore.

10. A swash plate compressor according to claim 1, wherein said cylindrical portion has a portion of a bottom-side end thereof which extends to a location radially opposed to said connecting portion, and wherein said cylindrical portion of said piston is formed with an annular groove which is radially opposed to an inner peripheral surface of said cylinder bore.

11. A swash plate compressor according to claim 1, wherein said projecting portion has a generally hollow cylindrical shape in side view, and wherein said cylindrical portion of said piston has a portion of a bottom-side end thereof which extends to a location radially opposed to said connecting portion, said cylindrical portion of said piston being formed with an annular groove which is radially opposed to an inner peripheral surface of said cylinder bore.

12. A swash plate compressor according to claim 1, wherein said projecting portion has a generally truncated cone shape in side view, and wherein said cylindrical portion of said piston has a portion of a bottom-side end thereof which extends to a location radially opposed to said connection portion, said cylindrical portion of said piston being formed with an annular groove which is radially opposed to an inner peripheral surface of said cylinder bore.

* * * * *